US006860758B1

(12) United States Patent
Kiely

(10) Patent No.: US 6,860,758 B1
(45) Date of Patent: Mar. 1, 2005

(54) SNAP FITTING ELECTRICAL CONNECTOR

(75) Inventor: Kenneth M. Kiely, Milford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 0 days.

(21) Appl. No.: 10/283,978

(22) Filed: Oct. 30, 2002

(51) Int. Cl.[7] ..... H01R 13/73
(52) U.S. Cl. ..... 439/557; 174/65 R; 439/567
(58) Field of Search ..... 439/567, 557, 439/553, 552, 357, 358, 142, 144, 578; 200/295–7; 174/65 R, 84 R, 84 S, 153 R

(56) References Cited

U.S. PATENT DOCUMENTS

| | | | | |
|---|---|---|---|---|
| 1,483,218 | A | | 2/1924 | Fahnestock |
| 1,725,883 | A | | 8/1929 | Recker |
| 1,830,250 | A | | 11/1931 | Tiefenbacher |
| 2,156,003 | A | | 4/1939 | Tinnerman |
| 2,445,633 | A | | 7/1948 | Peters |
| 2,823,932 | A | | 2/1958 | Schigut |
| 3,183,297 | A | | 5/1965 | Curtiss |
| 3,436,105 | A | | 4/1969 | Miklya |
| 3,544,705 | A | | 12/1970 | Winston |
| 3,631,738 | A | | 1/1972 | Harper |
| 3,788,582 | A | | 1/1974 | Swanquist |
| 3,814,467 | A | | 6/1974 | Van Buren, Jr. |
| 3,858,151 | A | | 12/1974 | Paskert |
| 3,993,333 | A | | 11/1976 | Biswas |
| 4,012,578 | A | | 3/1977 | Moran et al. |
| 4,021,604 | A | | 5/1977 | Dola et al. |
| 4,032,178 | A | | 6/1977 | Neuroth |
| 4,159,405 | A | * | 6/1979 | Semonchik et al. ..... 200/296 |
| 4,361,302 | A | | 11/1982 | Lass |
| 4,453,059 | A | * | 6/1984 | Fukushima ..... 200/296 |
| 4,468,535 | A | | 8/1984 | Law |
| 4,619,332 | A | | 10/1986 | Sheehan |
| 4,621,166 | A | | 11/1986 | Neuroth |
| 4,626,620 | A | | 12/1986 | Plyler |
| 4,657,212 | A | | 4/1987 | Gilmore et al. |
| 4,711,472 | A | | 12/1987 | Schnell |
| 4,773,280 | A | | 9/1988 | Baumgarten |
| 4,880,387 | A | | 11/1989 | Stikeleather et al. |
| 4,981,310 | A | | 1/1991 | Belisaire |
| 4,990,721 | A | | 2/1991 | Sheehan |
| 5,132,493 | A | | 7/1992 | Sheehan |
| 5,171,164 | A | | 12/1992 | O'Neil et al. |
| 5,189,258 | A | | 2/1993 | Pratesi |
| 5,266,050 | A | | 11/1993 | O'Neil et al. |
| 5,342,994 | A | | 8/1994 | Pratesi |
| 6,444,907 | B1 | * | 9/2002 | Kiely ..... 174/65 R |

* cited by examiner

*Primary Examiner*—Renee Luebke
(74) *Attorney, Agent, or Firm*—Fattibene & Fattibene; Paul A. Fattibene; Arthur T. Fattibene

(57) ABSTRACT

An electrical connector having an inlet end and an outlet end wherein the leading or outlet end is provided with a pair of spaced apart shoulders defining therebetween an annular recess and a snap fit retainer ring fitted onto the outlet end, the retainer ring having at least two series of spring tangs blanked out of the plane thereof, and which tangs are formed to effect a positive grounding connection with an associated electric box in the event any slight deviations are encountered within the parameters of the adopted standards, and whereby the annular recess functions to provide a relief for the spring tangs to facilitate and minimize the required insertion force and to insure a positive ground connection between the connector and the electrical box in the assembled position.

13 Claims, 2 Drawing Sheets

SNAP FITTING ELECTRICAL CONNECTOR

FIELD OF THE INVENTION

This invention relates to an electrical connector for connecting an electrical conductor to an electrical junction box, and more specifically to an electrical connector that can be readily connected to an electrical junction box with a snap fit.

BACKGROUND OF THE INVENTION

Connectors for attaching an electrical conductor to an electrical box or junction box are well known in the art. Such electric or junction boxes, fuse boxes and the like are uniformly used in virtually all residential and commercial buildings. As a result, such electrical boxes have been standardized. However, even though such electrical boxes have been generally standardized, it has been noted that while such boxes may conform to the standards adopted, there still exists some slight variations and deviations that occur within the accepted limited of the established standard, as for example the punch out opening formed in such electrical boxes may vary slightly in size by small amounts. Such minor size variations can cause a connector used in such instance to be improperly or not properly grounded.

It has also been observed that many of the commonly know connectors are limited for use with only a specific type of electrical conductor, e.g. applicable for use only with helically wound armor or BX type cable or for use with non-metallic sheathed cables, or co-axial cables and the like. Such known connectors are evidenced in U.S. Pat. Nos. 1,725,883; 1,830,250, and 2,823,932 for metallic armor or BX cables; U.S. Pat. Nos. 2,445,633; 4,711,472 and 5,132,493 for non-metallic conductors; and U.S. Pat. Nos. 3,544,705; 3,631,738 and 3,788,582 for co-axial type cables.

Other connectors are known, as for example, as evidenced by U.S. Pat. Nos. 5,171,164 and 5,266,050. While the connectors disclosed in said later patents are provided with a spring steel adaptor to effect the securing of the connector to an electrical box, some difficulty and excessive force may be required to effect the connection, as the connector does not provide any relief space to accommodate the deflection of the spring tangs or fingers during insertion through the knock out opening of an electrical box. It has been further observed that proper grounding may not be achieved in the event a given electrical box has a knock out opening which may be slightly oversized or the connector is slightly undersized, but still within the parameters of the adopted standards for electrical box and associated connectors.

Other connectors having a retaining clip for use with connectors for an electrical box are evidenced by U.S. Pat. Nos. 5,189,258 and 5,342,994. These patents relate to a novel retaining clip for use with connectors having a thread engaging portion that permits the securing of a threaded connector to an electrical box without threading the connector to the electrical box.

Accordingly, the instant invention is directed to further improvements relating to means for more effectively securing or connecting an electrical connector to an electrical box in a manner to insure a positive grounding despite any slight deviations of size that may occur within the adopted standards for such electrical boxes and associated connectors.

SUMMARY OF THE INVENTION

An object of this invention is to provide an electrical connector having a novel retaining means for effecting a snap fit connection with an associated electrical box that requires a minimum of force and a maximum of ease.

Another object is to provide an electrical connector having an improved retaining ring that will insure a more positive grounding effect despite any slight variations that may occur either in the construction of the electric box and/or the connector body.

Another object is to provide an electrical connector capable of use with metallic armored cables, non-metallic sheathed cable and/or co-axial cables and the like.

Another object is to provide an electrical connector that is relatively simple in construction, positive in operation and economical to fabricate.

The foregoing objects and other features and advantages are attained by an electrical connector having a connector body provided with an inlet end having an inlet opening sized to receive armored cable, BX type conductors, non-metallic sheathed conductors or co-axial cables and the like, and an outlet end defining the outlet opening. The connector body is provided with a radial outwardly extending flange intermediate the inlet and outlet ends thereof, and which intermediate flange functions as a stop to limit the insertion of the connector through the knock out opening of an electrical box.

The outlet end of the connector is provided with a pair of spaced apart shoulders which define therebetween an annular recess or space which circumscribes the outlet end. A radial outwardly extending end flange circumscribes the outermost shoulder. A snap fit retaining ring formed of suitable spring steel is loosely mounted on the spaced apart shoulders wherein the opposed peripheral edges of the retaining ring are confined between the intermediate flange and the end flange defining the outlet end or opening of the connector. The retaining or snap fit ring is provided with two series of a plurality circumferentially spaced tangs blanked out of the plane of the retainer or snap fit ring which are arranged in the assembled position to securely lock the connector in place to an electrical box, and at the same time insure a positive grounding connection therebetween despite any slight deviation in the size of the knock out opening or outlet end of the connector.

The inlet end of the connector body is provided with an inlet opening for receiving the outer armored or non-metallic covering of a conductor cable. The inlet end is further provided with opposed side walls which are interconnected by a top wall. An adjustable clamping member in the form of a C shaped member is supported on the inlet end of the connector to firmly secure the cable to the inlet end of the connector. An adjusting screw secures the clamping member to the inlet portion by which the clamping member can be adjusted as required.

Other features and advantages will become readily apparent in view of the drawings and detail description.

IN THE DRAWINGS

DETAIL DESCRIPTION

Figure 1:
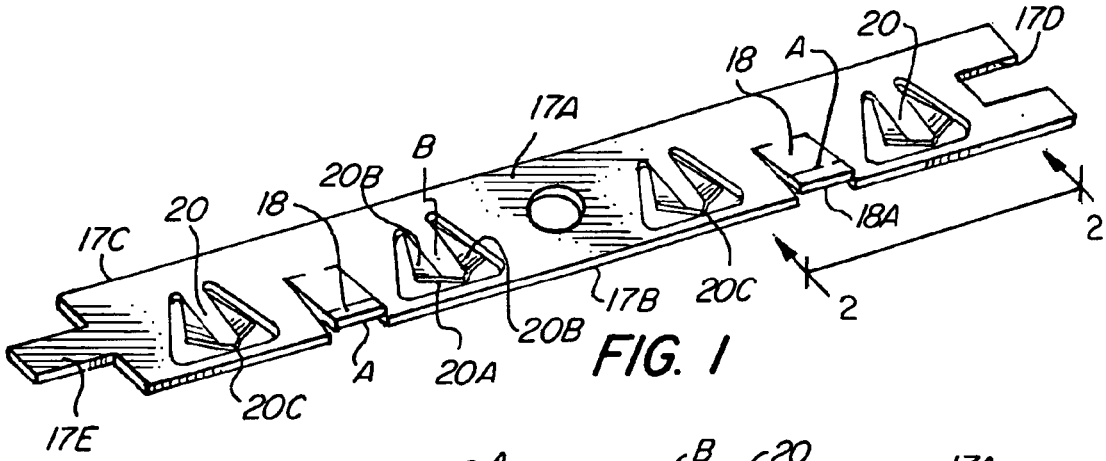
FIG. 1 is a perspective plan view of the blank from which the retaining ring embodied in the invention is formed, shown in an intermediate stage of forming same.

Referring to the drawings, there is illustrated an electrical connector 10 that embodies the instant invention. As shown, the electrical connector 10 includes a connector body 11 that has a cable or inlet end 11A and an outlet end 11B. The connector body 11 may be formed as a metal casting of any suitable metallic material such as zinc, aluminum, and/or any suitable metallic alloy. A radially outwardly extending intermediate flange 12 circumscribes the connector body 11 between the inlet end 11A and the outlet end 11B. The outlet end 11B is generally circular and is provided with a pair of spaced apart shoulders 13 and 14 circumscribing the outlet end 11B that define therebetween a space or recess 15. Circumscribing the shoulder 14 is a radially outwardly extending end flange 16.

Figure 2:
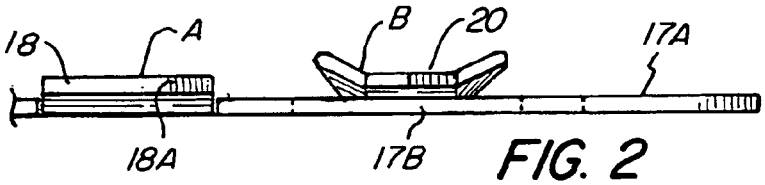
FIG. 2 is a partial end view taken along line 2—2 on FIG. 1.
Figure 3:
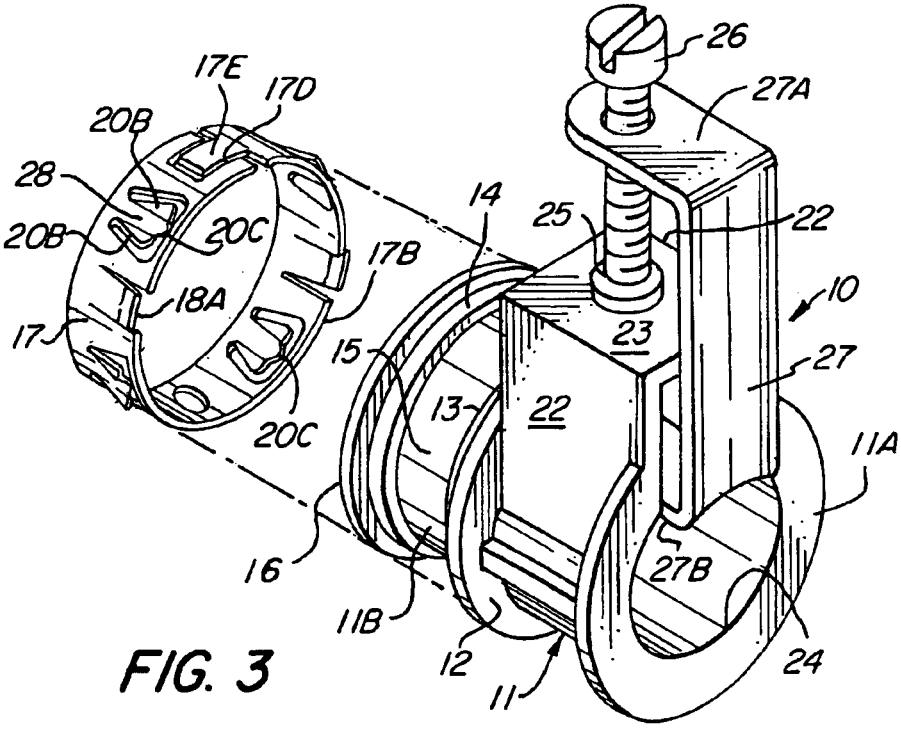
FIG. 3 is an exploded perspective view of an electrical connector embodying the invention.
Figure 4:
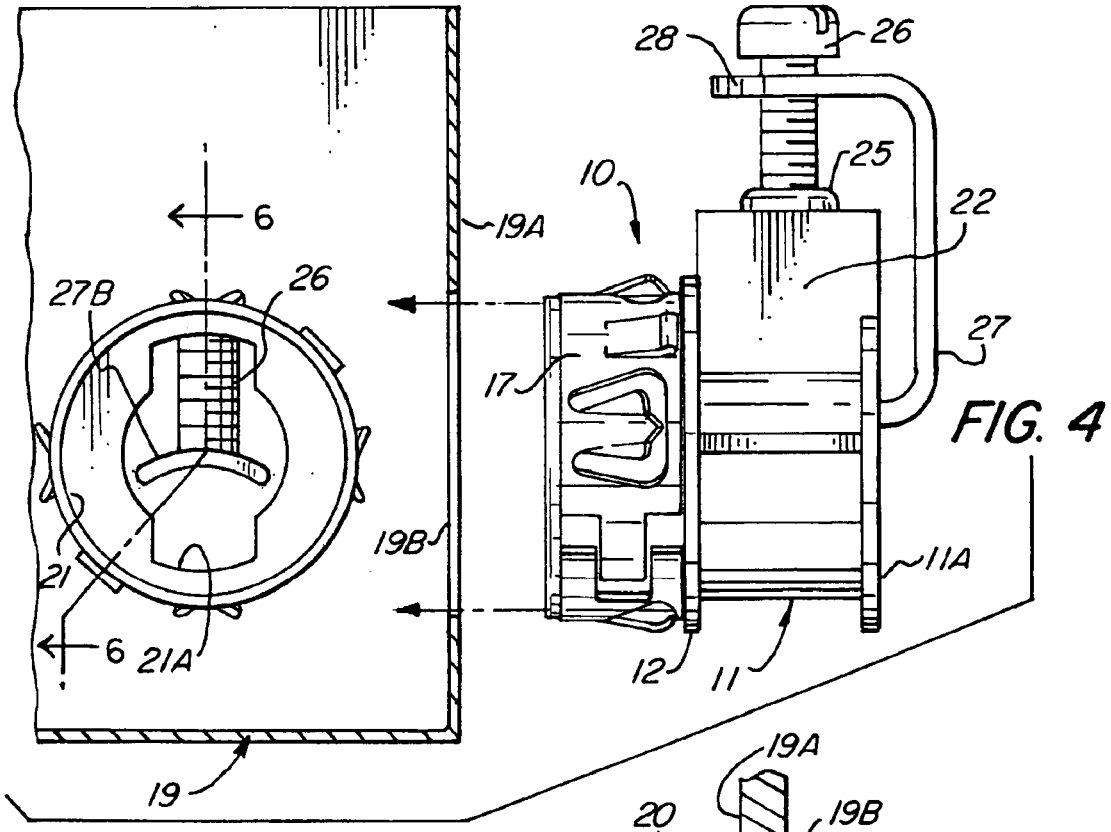
FIG. 4 is an exploded side view to illustrate the manner in which the connector is adapted to be secured to an electrical box, and illustrating another similar connector secured in place to another wall portion of an electrical box.
Figure 5:
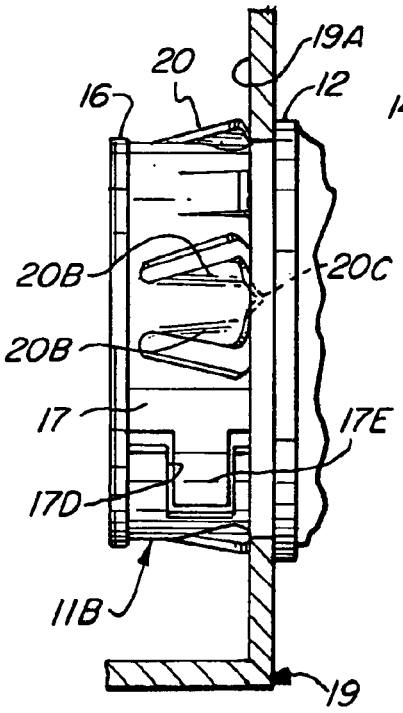
FIG. 5 is a detail side view of the connector embodying the invention connected to an electrical box.
Figure 6:
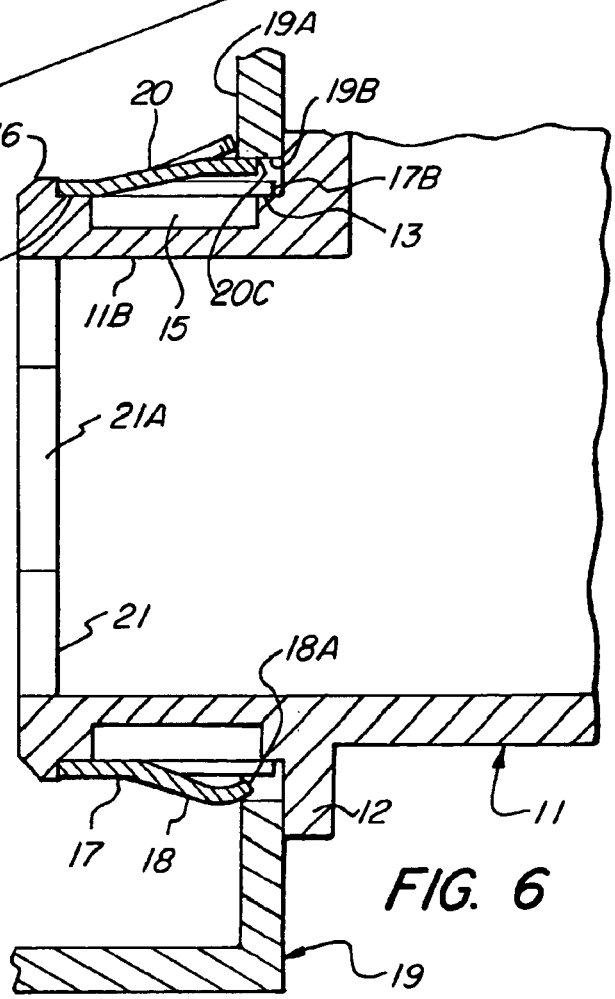
FIG. 6 is a sectional side view taken along line 6—6 on FIG. 4.

In accordance with this invention, a specially constructed retaining or snap fit ring 17 is loosely supported on shoulders 13 and 14, as best viewed in FIG. 6. The retainer or snap fit ring 17 is formed of a suitable spring type steel. Referring to FIGS. 1 and 2, the retainer or snap fit retainer ring 17 is formed from a flat blank 17A of spring steel having a width size sufficient to extend to and ride on or be supported by shoulders 13 and 14 in the assembled position, as best seen in FIGS. 4 to 6. The length of the blank 17A is such that, when formed into the retainer ring 17 as shown in FIG. 3, will define a complete ring having an expandable circumference sufficiently expandable to be fitted over the end flange 16 for positioning the same onto shoulders 13 and 14, as shown in FIG. 6.

Referring to FIGS. 1 and 2, the blank 17A of the retaining ring 17 is formed with two series of tangs, e.g. a series of A tangs and a series of B tangs. As shown, the series A and B tangs each include a plurality of similarly constructed tangs arranged to be circumferentially and alternately spaced about the circumference of the retainer ring 17 in the assembled state, as shown in FIG. 3.

The tangs or spring fingers 18 or the series A tangs are blanked out of the plane of blank 17A in a manner whereby the free ends 18A of tangs 18 include a portion of the longitudinal edge 17B of blank 17A that is adapted to be supported on shoulders 13 in the assembled position, as shown in FIG. 6. The tangs 18 of the series A tangs are bent outwardly of the plane of blank 17A in a cantilever manner. The free ends 18A of the respective tangs 18 of the series A tangs are then formed or arcuately shaped to define a compound arch or curvilinear cross sectional shape, as best seen in FIG. 6. As will be hereinafter described, the compounded curvilinear or rolled shape of the free ends 18A of tangs 18 in both a transverse and longitudinal direction will effect a positive grounding connection with a metallic electric box 19.

The tangs 20 of the series B tangs are blanked or die cut out of the plane of the blank 17A intermediate of the opposed longitudinal edges 17B and 17C. As best shown in FIG. 1, the free ends 20A of tangs 20 are spaced inwardly from the trailing edge 17B. Also, tangs 20 are bent outwardly of the plane of blank 17A as noted in FIG. 2 and FIG. 6. Tangs 20 are formed with opposed outwardly bent wing portions 20B. Tangs 20 are also provided with a projecting tit or projection 20C. As best seen in FIG. 6, the free ends of the wing portions 20B of tangs 20 engage the inner surface 19A of the electrical box 19, as seen in FIG. 6, while the projection or tit 20C engages the periphery of the knock out hole 19C to also insure positive electrical grounding between the connector 10 and the electrical box 19. The retainer ring blank 17A at one end is provided with a notch 17D and a complementary tongue 17E at the other end so that when formed into a ring, defines a complete 360° ring 17. As shown in FIGS. 3 and 5, the tongue 17E is received in notch 17D in a manner to prohibit any lateral play between the tongue 17E and groove 17D. As the ring 17 is formed of spring steel or other suitable metallic spring like material, the formed ring 17 is rendered sufficiently flexible to permit the retainer ring 17 to be assembled and supported onto the shoulders 13 and 14 of the outlet end 11B.

The outlet end 11B is provided with an end wall 21 having an elongated outlet opening 21A, the end wall 21 functioning as a stop for the cable covering or sheath, and whereby the unsheathed conductors can be extended through opening 21A.

The inlet portion 11A is generally of a shape for receiving various types of cables or conductors, an herein described. The inlet portion 11A is also provided with a means for securing the sheathed cable within the inlet portion 11A. In the illustrated embodiment, the securing means include a pair of spaced apart end wall extensions 22, 22 interconnected by a web or top wall 23 to define a bridge extending to one side of the inlet opening 24. The web or top wall 23 is provided with a tapped hole 25 for receiving an adjusting screw 26. Operatively associated with the adjusting screw 26 is a C shape clamp 27. As best seen in FIG. 3, the clamp 27 includes spaced apart leg portions 27A, 27B. The leg portion 27A is provided with an opening 28 for receiving the threaded shank of the adjusting screw 26 and the lower leg portion 27B being freely rotatable connected relative to the other end of the adjusting screw 26. The arrangement is such that when the adjusting screw 26 is rotated in one direction or the other, the clamp 27 will be moved into or out of the inlet end to effect the clamping or unclamping of the sheathed conductor (not shown). As best seen in FIG. 4, the lower leg portion 27B may be arcuately shaped to provide for a more positive clamping effect an the cable conductor.

In operation, with a connector 10 as described, and referring to FIGS. 4 to 6, it will be noted that a workman need only to insert the connector 10 through a knock out hole 19B to effect a positive snap fit connection. On inserting the outlet end 11B through the knockout opening 19B, the tangs 18 and 20 of the series A and B tangs will depress. In doing so, the recess or space 15 will function as a relief to minimize the force necessary to effect the insertion. This is because the tangs 18 and 20 can be depressed into the relief space 15 and not against the surface of the outlet end. As the intermediate flange 12 engages the wall of the junction box, the spring tangs 20 will spring outwardly whereby the free ends of the wing portion 20B, 20B of the tangs 20 engage the inner surface 19 of the electrical box while the projecting tit or projection 20C engages the inner periphery of the knock out hole 19B, as best seen in FIG. 6. Simultaneously, the arcuate shaped free end 18A of tangs 18 of the series A tangs will positively engage the edge of the knock out hole 19B, as best seen in FIG. 6. The arcuate shape of the free end 18A of tangs 18 thus enable tangs 18 to make a positive ground connection even if the knock out holes may vary slightly in size from box to box or hole to hole.

From the foregoing, the described connector 10 can be readily inserted with a snap fit with a minimum of insertion force. At the same time, the tangs 18 and 20 of the locking or retainer ring 17 are shaped to provide positive grounding of the connector with the associated electric box. The annular recess or space 15 provides a relief which allows the tangs 18 and 20 to be depressed into the underlying recess 15 to facilitate the insertion of the connector.

With the construction described, it will be further noted that the connector 10 in the assembled position with the electrical box 19 is firmly secured to the electrical box as the electrical box wall is tightly squeezed between the intermediate stop flange 12 and the retaining tangs 20, as noted in FIGS. 5 and 6, and thereby, virtually eliminates any play or movement between the connector 10 and its associated electrical box 19.

While the present invention has been described with respect to a particular embodiment, it will be understood that various modifications may be made without departing from the spirit or scope of the invention.

What is claimed is:

1. An electrical connector comprising:

a connector body having a cable inlet portion and an outlet portion, said body portion including a pair of spaced apart radially outwardly extending flanges circumscribing said outlet portion, said outlet portion including a pair of spaced apart shoulders disposed between said spaced apart flanges, said shoulders extending radially outwardly of said outlet portion a distance less than said spaced apart flanges, a recess defined between said shoulders about said outlet portion, an annular retainer ring supported on said shoulders between said flanges, a plurality of spring tangs blanked out of said retainer ring, said tangs being circumferentially spaced about said retainer ring and projecting outwardly from said retainer ring in a cantilever manner, said tangs being disposed above said recess whereby said recess provides a relief space for said tangs to facilitate the insertion of said connector through a knock out hole of an electric box to effect a snap fit connection.

2. An electrical connector as defined in claim 1 wherein said plurality of tangs include:

a series of tangs blanked out of said retainer ring whereby each tang of said series of tangs has a free end which includes a longitudinal edge portion of said retainer ring, and said longitudinal edge portion being arcuately shaped so as to engage the edge of a knock out hole of the electric box for effecting electrical grounding of said connector.

3. An electrical connector as defined in claim 2 wherein one of said radially outwardly extending flanges is disposed about said connector body between said inlet portion and said outlet portion, whereby said one flange defines a stop.

4. An electrical connector comprising:

a connector body having a cable inlet portion and an outlet portion, said outlet portion including a pair of spaced apart shoulders, said shoulders extending radially outwardly of said outlet portion, a recess defined between said shoulders about said outlet portion, an annular retainer ring supported on said shoulders, a plurality of spring tangs blanked out of said retainer ring, said tangs being circumferentially spaced about said retainer ring and projecting outwardly from said retainer ring in a cantilever manner, said tangs being disposed above said recess whereby said recess provides a relief space for said tangs to facilitate the insertion of said connector through a knock out hole of an electric box to effect a snap fit connection, wherein said plurality of tangs include:

a series of tangs blanked out of said retainer ring whereby each tang of said series of tangs has a free end which includes a longitudinal edge portion of said retainer ring, and said longitudinal edge portion being arcuately shaped so as to engage the edge of a knock out hole of the electric box for effecting electrical grounding of said connector, wherein said free end of each of said tangs of said series of tangs includes a compound curvature in both a transverse and longitudinal direction.

5. An electrical connector comprising:

a connector body having a cable inlet portion and an outlet portion, said outlet portion including a pair of spaced apart shoulders, said shoulders extending radially outwardly of said outlet portion, a recess defined between said shoulders about said outlet portion, an annular retainer ring supported on said shoulders, a plurality of spring tangs blanked out of said retainer ring, said tangs being circumferentially spaced about said retainer ring and projecting outwardly from said retainer ring in a cantilever manner, said tangs being disposed above said recess whereby said recess provides a relief space for said tangs to facilitate the insertion of said connector through a knock out hole of an electric box to effect a snap fit connection, wherein said plurality of tangs include:

a series of tangs blanked out of said retainer ring whereby each tang of said series of tangs has a free end which includes a longitudinal edge portion of said retainer ring, and said longitudinal edge portion being arcuately shaped so as to engage the edge of a knock out hole of the electric box for effecting electrical grounding of said connector, and said plurality of tangs include a second series of tangs circumferentially spaced about said retainer ring, each of said second series of tangs being disposed about said retainer ring intermediately between the opposed longitudinal edges of said retainer ring, said tangs of said second series of tangs having a free end and opposed outer wing portions adapted to engage an inner surface of the electric box, and said free end of each of said second series of tangs having a projecting tit adapted to engage a peripheral portion of the knock out hole of the electrical box.

6. An electrical connector comprising:

a connector body having a cable inlet portion and an outlet portion, said outlet portion including a pair of spaced apart shoulders, said shoulders extending radially outwardly of said outlet portion, a recess defined between said shoulders about said outlet portion, an annular retainer ring supported on said shoulders, a plurality of spring tangs blanked out of said retainer ring, said tangs being circumferentially spaced about said retainer ring and projecting outwardly from said retainer ring in a cantilever manner, said tangs being disposed above said recess whereby said recess provides a relief space for said tangs to facilitate the insertion of said connector through a knock out hole of an electric box to effect a snap fit connection, wherein said inlet portion includes a pair of opposed spaced side wall extensions, a web interconnected between said side wall extensions, said web having a tapped hole, an adjusting screw threaded in said tapped hole, and a clamping member connected to said screw whereby the rotation of said adjusting screw in one direction or the other causes said clamping member to move toward a clamping and unclamping position in accordance to the direction of rotation of said adjusting screw.

7. An electrical connector as defined in claim 6 wherein said clamping member includes a C shaped clamp, said C shaped clamp having opposed leg portions, one of said leg portions having an opening for receiving said adjusting screw, and said other leg portion being connected to the end of said adjusting screw whereby the rotation of said adjusting screw effects the displacement of said clamping member toward a clamping and unclamping position depending upon the rotation of said adjusting screw.

8. A snap fit retainer ring adapted for use on an electrical connector to effect a snap fit connection to an electrical box comprising:

a blank of a spring type metallic material rolled to define a ring, said blank having opposed longitudinal extending edges and opposed end portions, said opposed end portions being slightly spaced apart when said blank is formed to define said ring, a plurality of tangs longitudinally spaced along the length of said blank, said plurality of tangs including a series of tangs blanked out of said blank, each of said tangs of said series of tangs being bent outwardly of said blank and having a free end thereof including a longitudinal edge portion of said blank, said edge portion of said tangs of said series of tangs being formed with an inwardly arcuate curvature in both a transverse and longitudinal direction.

9. A snap fit retainer ring as defined in claim 8 wherein one of said opposed ends of said blank having a notch formed therein and the other of said opposed ends having a complementary tongue adapted to be received within said notch in the ring forming position of said blank.

10. A snap fit retainer ring as defined in claim 8 wherein said plurality of tangs include:

a second series of tangs, said second series of tangs including tangs blanked out of said blank intermediately and wholly between the opposed longitudinally extending edges, said tangs of said second series being bent out of said blank, and said tangs of said second series of tangs having an opposed outwardly bent wing portion having a free end adapted to engage the inner surface of an electrical box, and said tangs of said second series having a projecting tit to engage the peripheral surface of the knock out hole of the electrical box to effect a grounding contact when the electrical connector is assembled to the electrical box.

11. A snap fit retainer ring as defined in claim 10 wherein the tangs of said first series of tangs and the tangs of said second series of tangs are alternately spaced along the length of said blank.

12. A snap fit retainer ring as defined in claim 11 wherein said blank includes a leading longitudinal edge and a trailing longitudinal edge, and said free ends of said tangs of said second series of tangs are spaced inwardly of said trailing longitudinal edge of said blank a distance sufficient to accommodate a wall thickness of the electrical box.

13. For use in combination with an electrical box provided with at least one or more knock out holes, an electrical connector comprising:

a connector body defining an inlet portion and a connected outlet portion, an outwardly radially extending flange circumscribing said connector body between said inlet portion and said outlet portion, said flange forming a stop to limit the insertion of said connector body portion through a knock out opening of the electrical box, said outlet portion including a pair of spaced apart shoulders circumscribing said outlet portion, an annular recess disposed between said shoulders circumscribing said outlet portion, a snap fit retainer ring supported on said spaced apart shoulders, a radially outwardly extending end flange disposed adjacent the outermost shoulder for retaining said snap fit ring on said outlet portion between said intermediate flange and said end flange, said snap fit retainer ring including a plurality of circumferentially spaced tangs, said plurality of tangs including a first series of spaced apart tangs, said tangs of said first series of tangs being blanked out of said retainer ring, said tangs of said first series of tangs being bent laterally outwardly of said retainer ring whereby the free end of said first series of tangs includes a longitudinally edge portion of said retainer ring, said free longitudinal edge portions of said tangs of said first series of tangs having an inwardly compound curvature in both a transverse and longitudinal direction, and said plurality of tangs including a second series of tangs, said tangs of said second series of tangs being blanked out of said retainer ring disposed wholly between the opposed longitudinal edges of said retainer ring, said tangs of said second series of tangs being bent laterally outwardly of said retainer ring, and said tangs of said second series of tangs including opposed outwardly bent wing portions and a projecting tit whereby the free ends of said wing portions are adapted to engage the inner surface of the electrical box and said projecting tit engaging the inner periphery of the knock out hole of the electric box in the assembled position of the electric box and connector to insure a grounding connection therebetween, said annular recess defining a relief space for accommodating the deflection of said tangs as the outlet portion of said connector is inserted into the knock out hole of a junction box to facilitate insertion thereof, and said inlet portion including an opposed pair of side wall extensions, a web interconnected between said side wall extensions, said web having a tapped hole, an adjusting screw threaded to said tapped hole, and a clamping member connected to said adjusting screw, said clamping member including a C shaped member having opposed spaced leg portions, one of said leg portions having an opening for loosely receiving said adjusting screw, the other of said leg portions extends into said inlet portion and is connected to the end of said adjusting screw whereby rotation of said adjusting screw in one direction or the other causes said clamping member to move toward a clamping and unclamping position in accordance with the direction of rotation of said adjusting screw.

* * * * *